US007921784B2

(12) United States Patent
Ogburn et al.

(10) Patent No.: US 7,921,784 B2
(45) Date of Patent: Apr. 12, 2011

(54) SNAP-TOGETHER PALLET

(75) Inventors: Sean T. Ogburn, Lawrenceville, GA (US); William P. Apps, Alpharetta, GA (US); Robert V. Gruber, Dallas, TX (US); Jeffrey L. Wilkerson, Grapevine, TX (US)

(73) Assignee: Rehrig Pacific Company, Los Angeles, CA (US)

( * ) Notice: Subject to any disclaimer, the term of this patent is extended or adjusted under 35 U.S.C. 154(b) by 1275 days.

(21) Appl. No.: 10/903,661

(22) Filed: Jul. 29, 2004

(65) Prior Publication Data

US 2006/0032413 A1 Feb. 16, 2006

(51) Int. Cl.
*B65D 19/38* (2006.01)

(52) U.S. Cl. ..... 108/57.25

(58) Field of Classification Search ..... 108/57.25, 108/57.26, 901, 902, 51.11
See application file for complete search history.

(56) References Cited

U.S. PATENT DOCUMENTS

| | | | | | |
|---|---|---|---|---|---|
| 4,843,976 | A * | 7/1989 | Pigott et al. | 108/56.1 |
| 5,094,175 | A * | 3/1992 | Christie | 108/56.1 |
| 5,197,395 | A * | 3/1993 | Pigott et al. | 108/56.1 |
| 5,388,533 | A * | 2/1995 | Pigott et al. | 108/56.3 |
| 5,483,899 | A * | 1/1996 | Christie | 108/56.3 |
| 5,579,686 | A * | 12/1996 | Pigott et al. | 108/56.1 |
| 5,720,227 | A * | 2/1998 | Baker et al. | 108/53.3 |
| 5,791,261 | A * | 8/1998 | John et al. | 108/56.3 |
| 5,887,529 | A * | 3/1999 | John et al. | 108/56.1 |
| 6,006,677 | A * | 12/1999 | Apps et al. | 108/57.25 |
| 6,109,190 | A * | 8/2000 | Hale et al. | 108/57.25 |
| 6,250,234 | B1 * | 6/2001 | Apps | 108/57.25 |
| 6,283,044 | B1 * | 9/2001 | Apps | 108/57.25 |
| 6,874,428 | B2 * | 4/2005 | Apps | 108/57.25 |
| 6,955,128 | B2 * | 10/2005 | Apps | 108/57.25 |
| 2003/0061974 | A1 * | 4/2003 | Smyers | 108/56.1 |
| 2003/0075081 | A1 * | 4/2003 | Apps | 108/56.3 |
| 2004/0149180 | A1 * | 8/2004 | Apps et al. | 108/57.25 |
| 2005/0103236 | A1 * | 5/2005 | Apps | 108/56.3 |
| 2005/0193929 | A1 * | 9/2005 | Ingham | 108/56.3 |

FOREIGN PATENT DOCUMENTS

| | | | |
|---|---|---|---|
| DE | 3205910 | A1 * | 11/1983 |
| DE | 4422226 | A1 * | 1/1996 |
| EP | 400640 | A1 * | 12/1990 |

* cited by examiner

*Primary Examiner* — Darnell M Jayne
*Assistant Examiner* — Matthew W Ing
(74) *Attorney, Agent, or Firm* — Carlson, Gaskey & Olds

(57) ABSTRACT

A pallet for use with a fork lift includes a top deck, a mid-top member and a base. The top deck has a plurality of ribs extending downwardly and a plurality of column-receiving recesses formed on the underside thereof. The base includes a plurality of columns projecting substantially vertically and received within the recesses of the top deck. Snap-tabs secure the columns to the deck. A generally planar mid-top member is secured to the plurality of ribs on the deck and has a plurality of openings into which are received the plurality of columns. The mid-top member is sandwiched between the ribs of the top deck and shoulders formed on the outer periphery of the columns.

12 Claims, 17 Drawing Sheets

SNAP-TOGETHER PALLET

BACKGROUND OF THE INVENTION

The present invention relates generally to pallets and more particularly to a snap-together pallet.

Pallets are often used to store and transport goods. Pallets maintain the goods at a distance above the floor such that they can readily be lifted and moved by a forklift. Plastic pallets are lighter and more durable than wooden pallets.

Many plastic pallets have separately molded upper and lower decks separated by columns that define the fork-receiving areas. The upper and lower decks and the columns are molded separately and subsequently connected via adhesive, hot plate welding, heat stakes, or similar methods. These connection processes can be time-consuming and raise the assembly cost.

Pallets with some snap-together assembly have been developed. Two such pallets, developed by the assignee of the present application, are disclosed in U.S. Pat. Nos. 6,006,677 and 6,622,641. Those pallets include a top deck having a plurality of ribs extending downward. Snap-tabs connect a plurality of columns to the top deck. Ribs in the top deck provide strength and rigidity to the top deck.

SUMMARY OF THE INVENTION

A pallet according to the present invention provides increased strength to a top deck that is snap-fit to columns of a base. The pallet generally includes a top deck, a mid-top member and a base. The top deck has a plurality of ribs extending downwardly and a plurality of column-receiving recesses formed on the underside thereof.

The base includes a plurality of columns projecting substantially vertically and received within the recesses of the top deck. The columns define fork-receiving regions therebetween. Snap-tabs secure the columns to the deck.

A generally planar mid-top member has a plurality of openings corresponding to the plurality of columns. The mid-top member is sandwiched between the ribs of the top deck and shoulders formed on the outer periphery of the columns, which partially extend into the openings of the mid-top member.

In one embodiment, the mid-top member is secured directly to the plurality of ribs on the deck. In another embodiment, the mid-top member is first snap-fit to the top deck. The assembled mid-top member and top deck are then assembled to the base via snap-fit connections.

Pallets according to the present invention provide top decks that are stronger and more rigid. The pallets are also easier to assemble than previous pallets.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
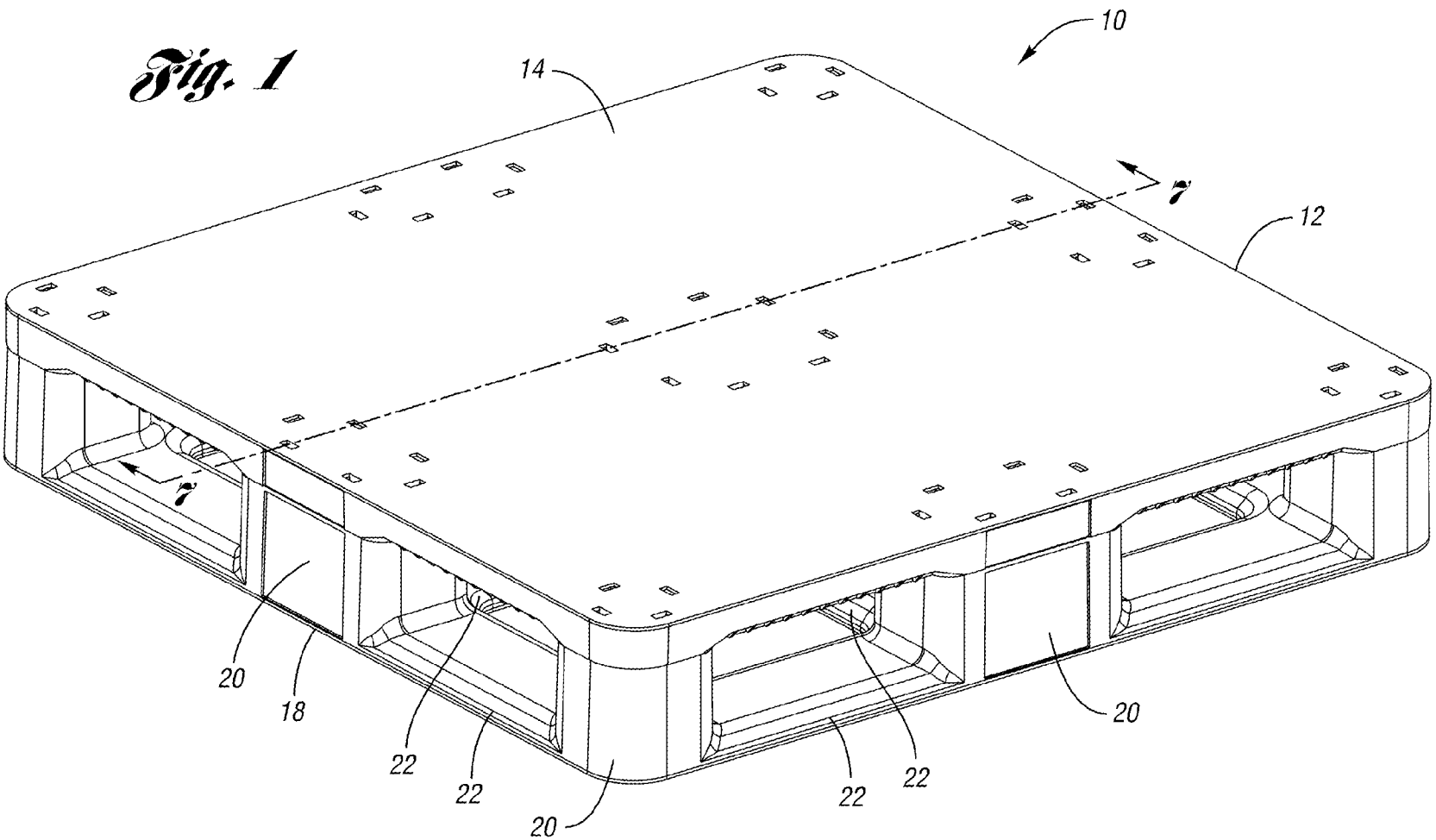
FIG. 1 is a perspective view of a pallet according to a first embodiment of the present invention.

A pallet 10 according to a first embodiment of the present invention includes a top deck 12 having a generally planar upper member 14 for supporting goods at a distance above the floor. The top deck 12 is secured to a base 18 having a plurality of generally vertical columns 20 connected by runners 22 and defining fork-receiving areas.

Figure 2:
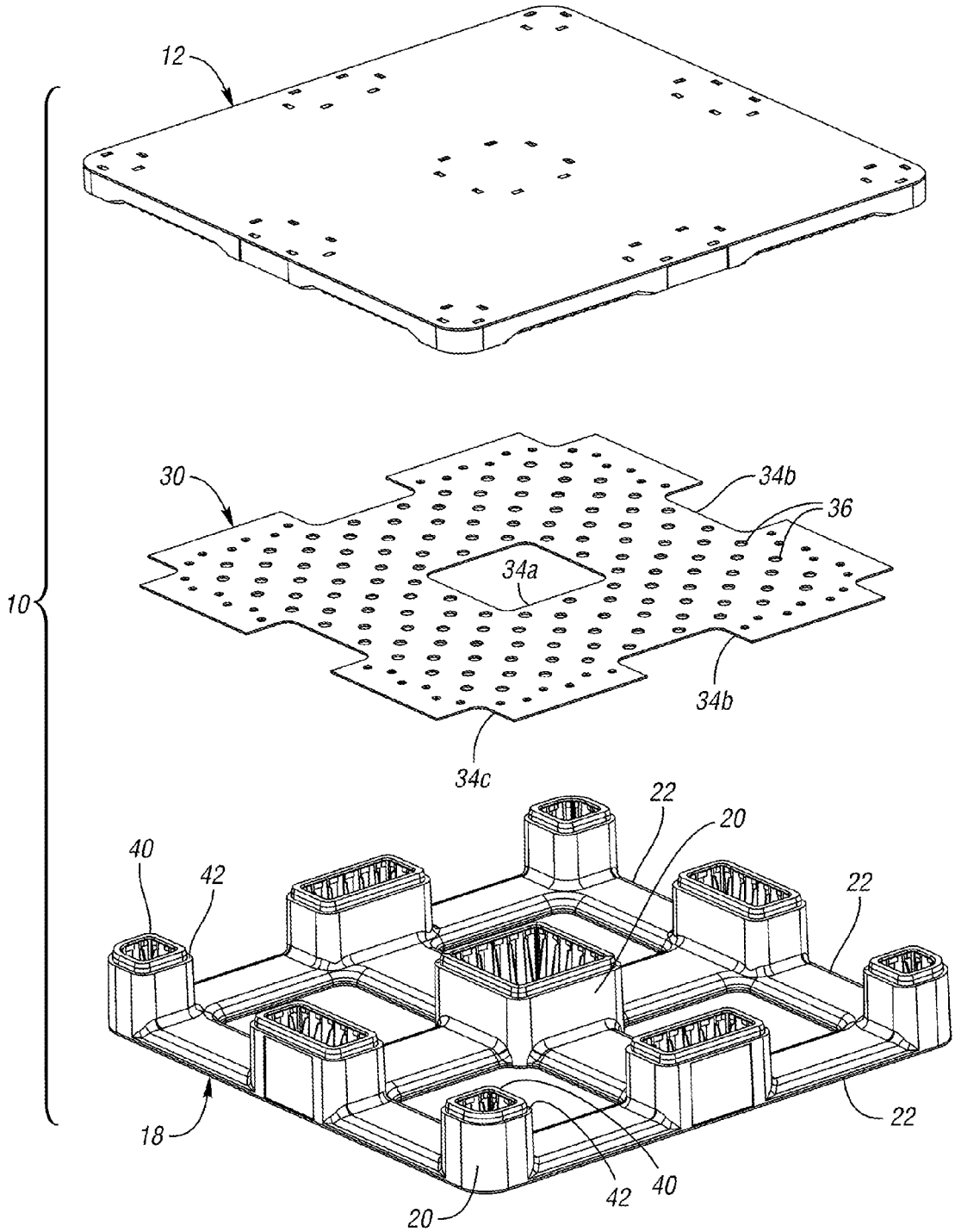
FIG. 2 is an exploded view of the pallet of FIG. 1.

FIG. 2 is an exploded view of the pallet 10. A mid-top member 30 is sandwiched between the top deck 12 and the base 18. The mid-top member 30 is a generally planar, rigid, synthetic resin plate having a plurality of openings 34, including a center opening 34*a*, side openings 34*b* and corner openings 34*c*. The openings 34 correspond to and are aligned with the columns 20 of the base 18. The columns 20 each include an upper portion 40 having a reduced outer dimension, thereby forming a shoulder 42 adjacent the upper portion 40.

Figure 3:
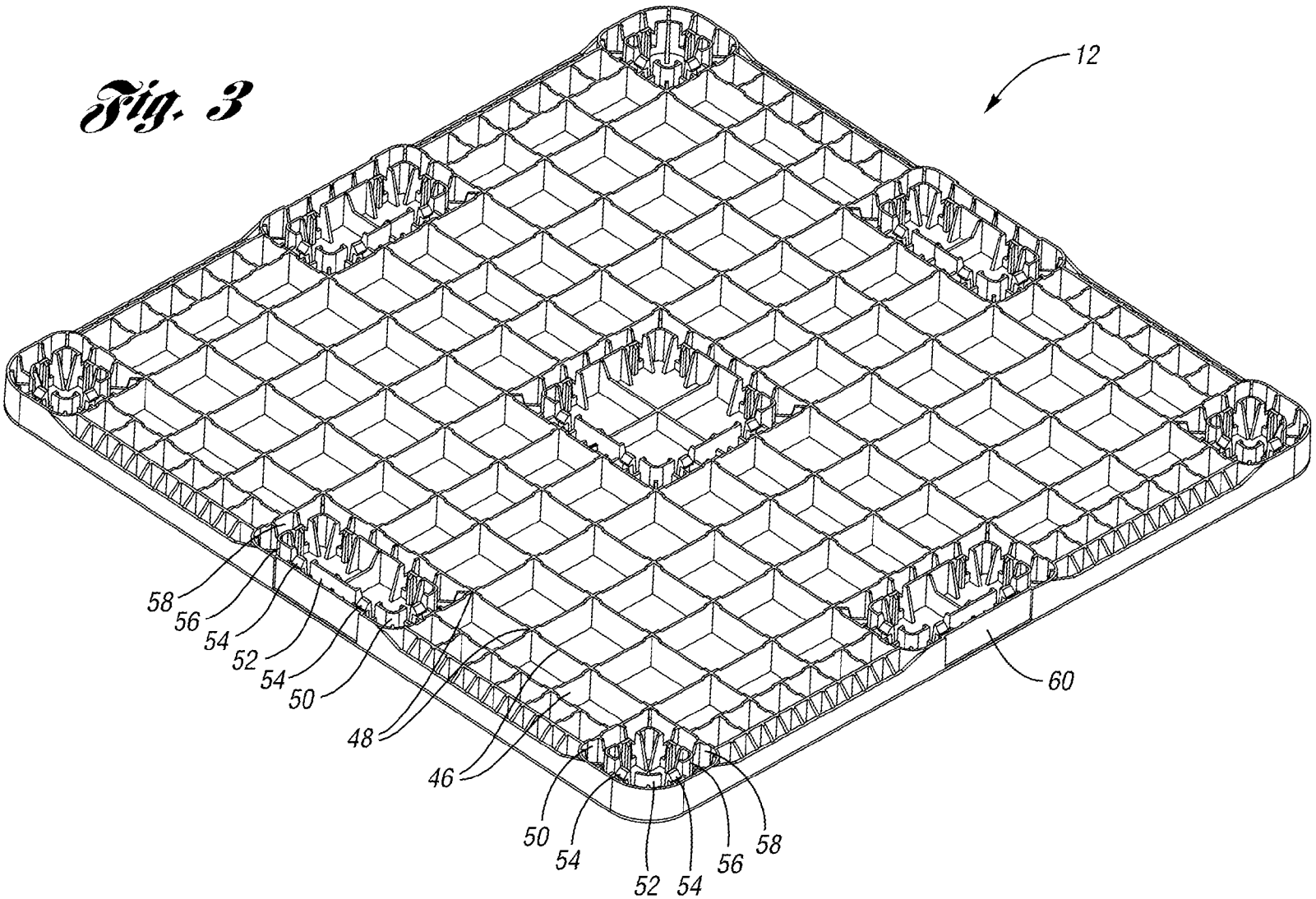
FIG. 3 is a bottom perspective view of the top deck of the pallet of FIG. 1.

FIG. 3 is a bottom perspective view of the top deck 12. The underside of the top deck 12 includes a plurality of intersecting, transverse ribs 46 extending downward. At each intersection of the ribs 46, the ribs 46 are slightly taller to form downward projections 48. The top deck 12 includes a plurality of column-receiving recesses 50. A plurality of interior ribs 52 and snap-tabs 54 extend downward within each recess 50. Short channel ribs 56 between the ribs 46 and the interior ribs 52 of each recess 50 define a channel 58. A lip 60 extending around the periphery of the top deck 12 is taller when adjacent each recess 50 (other than the center recess 50) and is spaced from the interior ribs 52 and snap-tabs 54.

Figure 4:
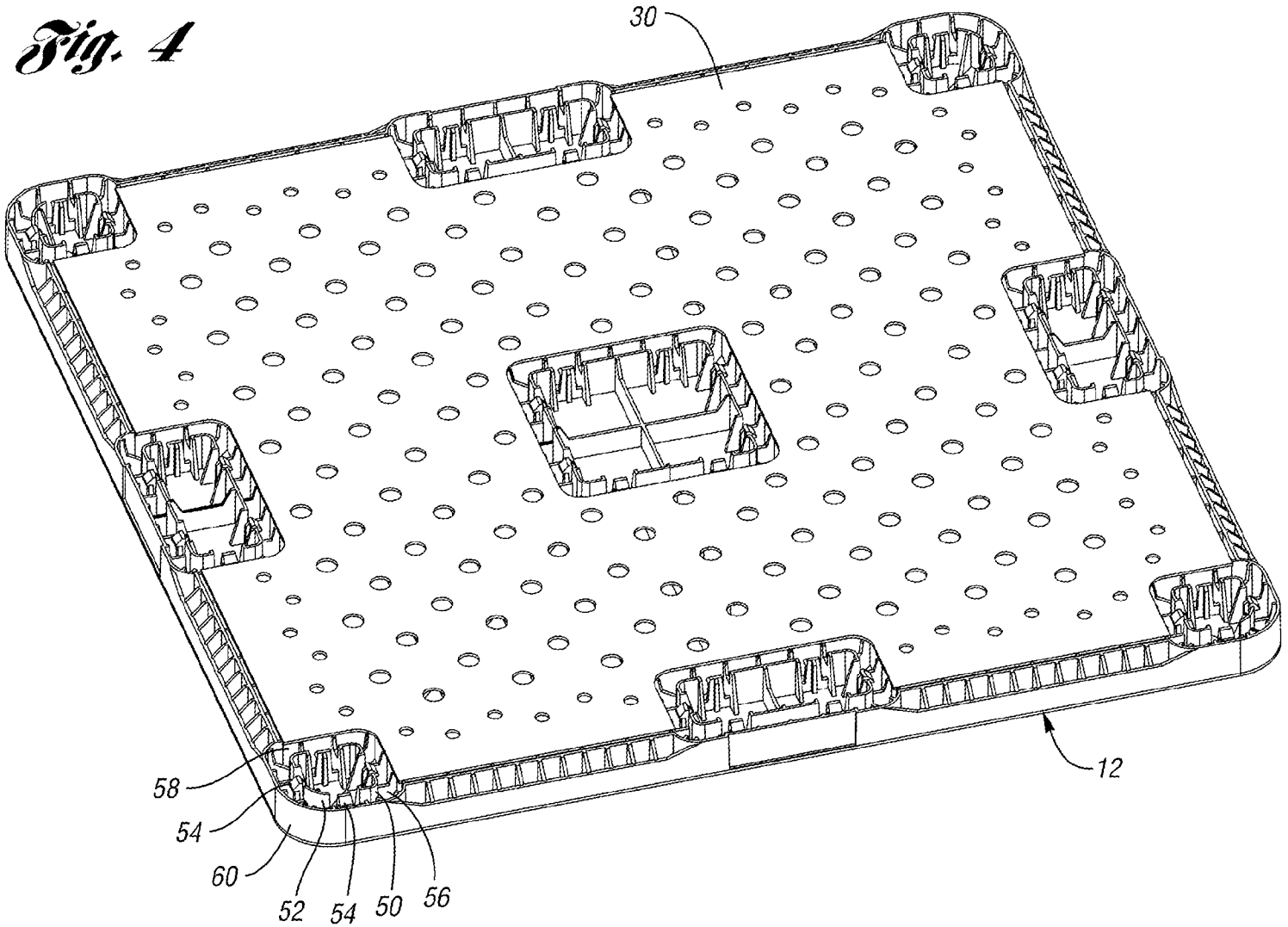
FIG. 4 is a bottom perspective view of the top deck of FIG. 3 connected to the mid-top member.

FIG. 4 is a bottom perspective view of the mid-top member 30 connected to the top deck 12. As shown, the openings 34 in the mid-top member 30 are aligned with the recesses 50 in the top deck 12, such that the recesses 50, channel 58, short channel ribs 56, interior ribs 52 and snap-tabs 54 are accessible.

Figure 5:
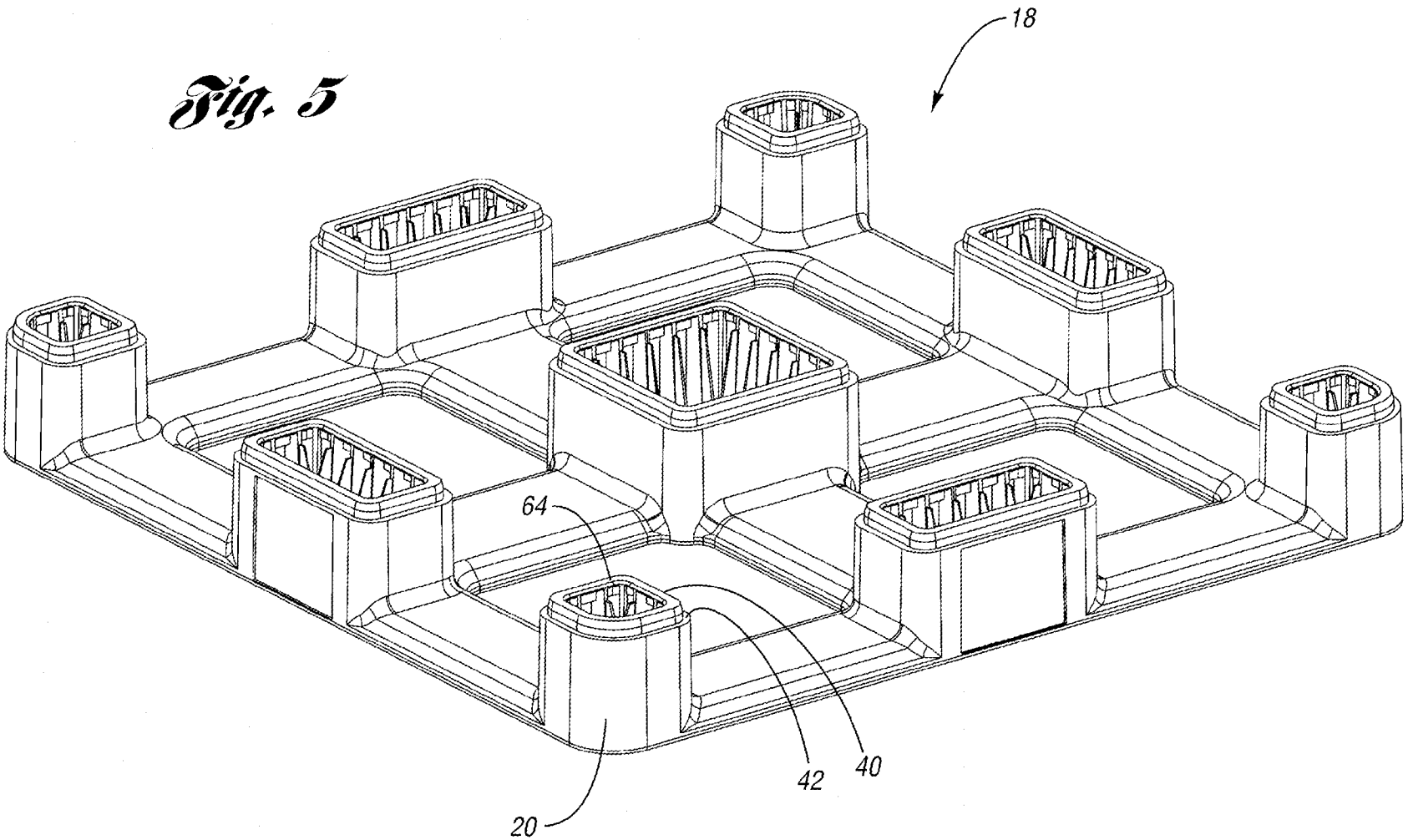
FIG. 5 is a perspective view of the base of the pallet of FIG. 1.

FIG. 5 is a perspective view of the base 18. Each column 20 includes the upper portion 40 of reduced outer dimension to form the shoulder 42. A flange 64 extends radially inward from the top of the upper portion 40 into a hollow of the column 20.

Figure 6:
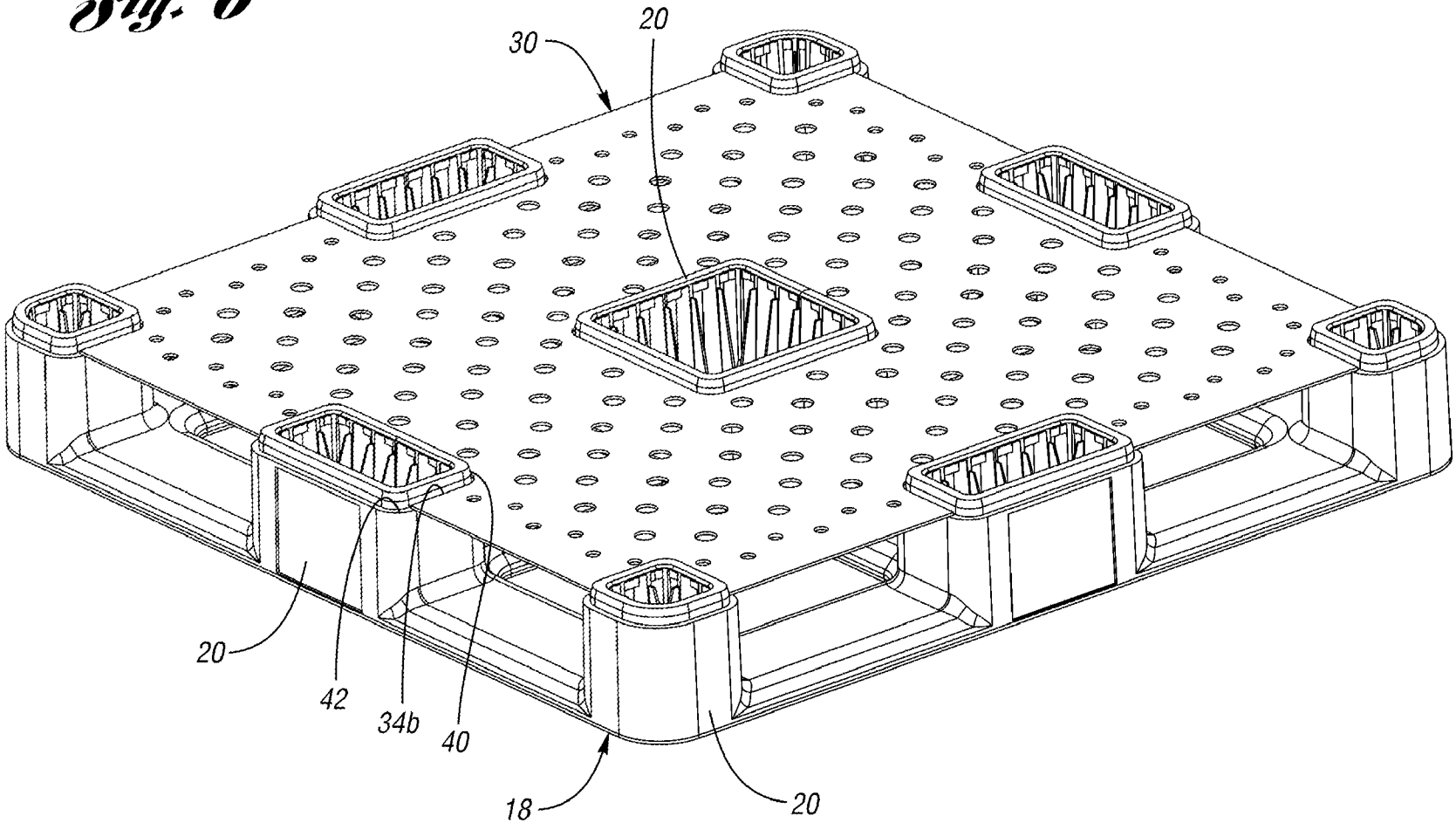
FIG. 6 shows the alignment of the mid-top member on the base of FIG. 5.

FIG. 6 is a perspective view of the base 18 with the mid-top member 30 aligned on the base 18. The columns 20 are received in the openings 34 of the mid-top member 30. The mid-top member 30 rests on the shoulders 42 of the columns 20 of the base 18, such that the upper portions 40 protrude through the openings 34 in the mid-top member 30.

Figure 7H:
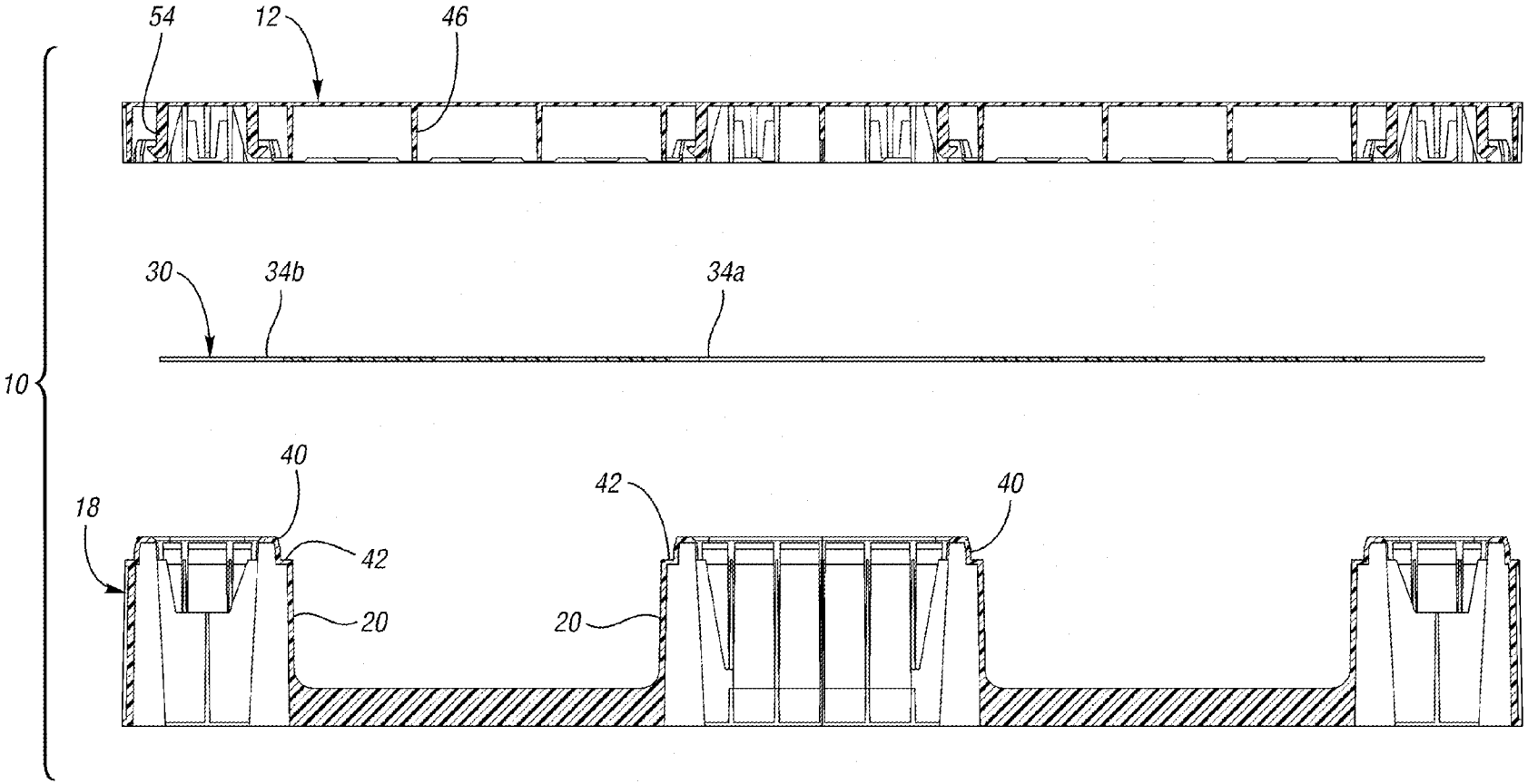
FIG. 7*a* is an exploded sectional view taken along lines 7-7 of FIG. 1.
FIG. 7*b* is an assembled view similar to FIG. 7*a*.
Figure 7B:
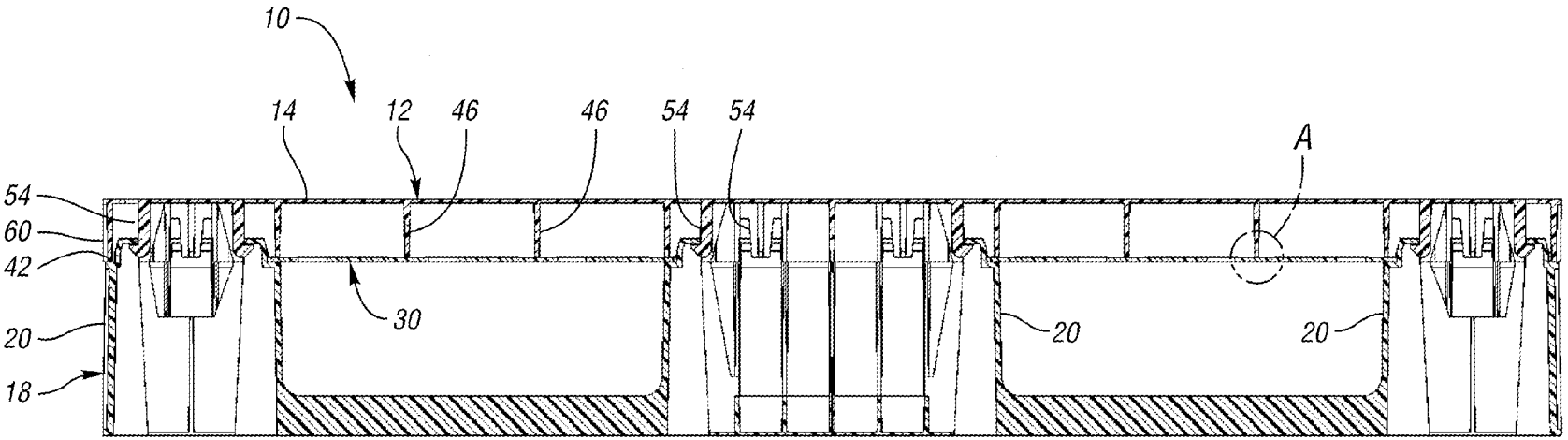

FIGS. 7*a* and 7*b* are sectional exploded and assembled views, respectively, of the pallet taken along line 7-7 of FIG. 1. The upper portions 40 of the columns 20 are received in the openings 34 in the mid-top member 30. The top deck 12 is secured to the base 18 via the connection of the snap-tabs 54 to the columns 20. The mid-top member 30, together with the ribs 46 and the planar upper member 14, forms box beam sections in the top deck 12. The box beam sections provide increased strength and rigidity to the top deck 12. The lip 60 rests on the shoulder 42 adjacent each peripheral column 20.

Figure 8:
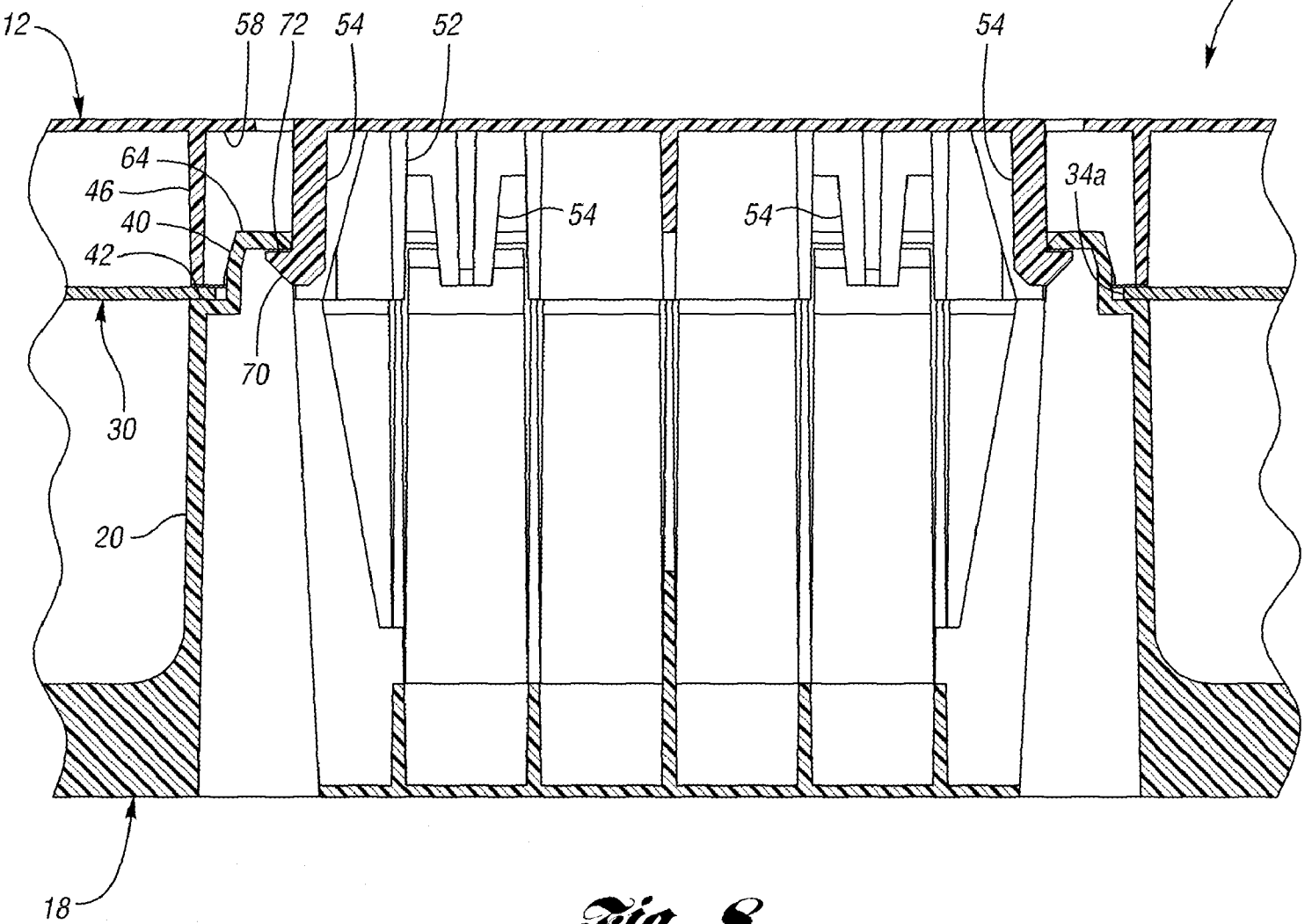
FIG. 8 is an enlarged view of the area around the center column of FIG. 7*b*.

An enlarged view of the area around the center column 20 is shown in FIG. 8. Connection to the other columns 54 is similar. When assembled, the mid-top member 30 rests on the shoulders 42 of the columns 20, such that the upper portion 40 is received within the opening 34 of the mid-top member 30. The ribs 46 of the top deck 12 abut the upper surface of the mid-top member 30. The top deck 12 is secured to the base via the snap-tabs 54 in the columns 20. The columns 20 are inserted into the channels 58 of the recesses 50 on the top deck 12 as the snap-tabs 54 and interior ribs 52 are inserted into the columns 20. The sloped portion 70 of each snap-tab 54 initially abuts the flange 64 of the column 20. Upon further insertion, the snap-tab 54 is deformed inwardly until it snaps past the flange 64 and returns to its undeformed position, with the flange 64 secured above the shoulder 72 of the snap-tab 54, thereby retaining the top deck 12 and the mid-top member 30 to the base 18.

Figure 9A:
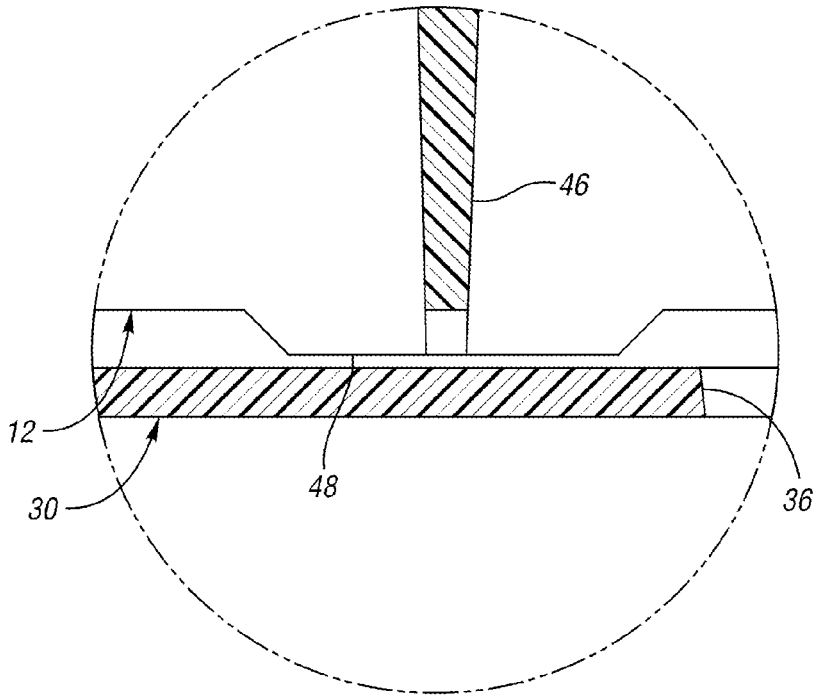
FIG. 9*a* is an enlarged view of the Area A of FIG. 7*b* prior to attachment of the top deck to the mid-top member.
Figure 9B:
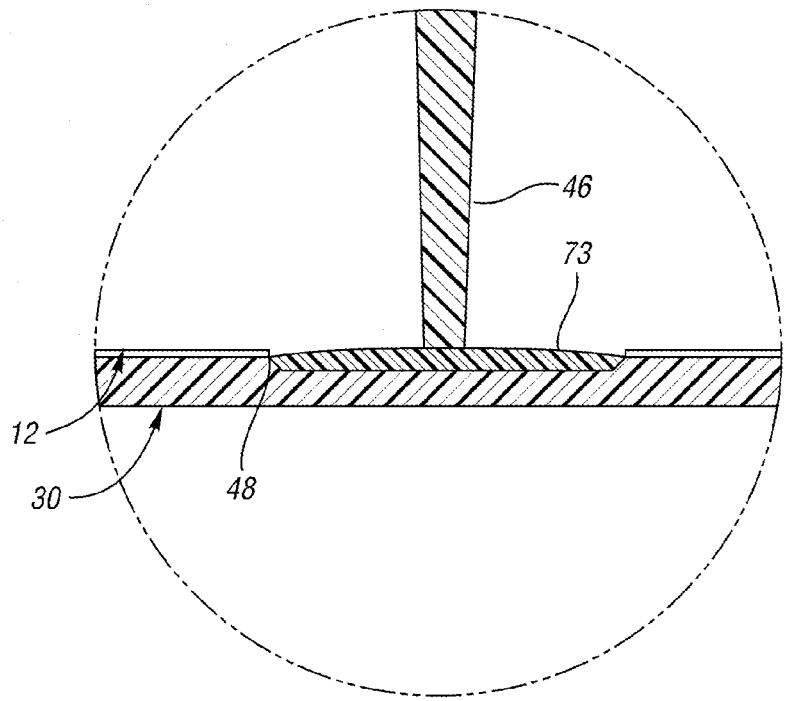
FIG. 9*b* is the area of FIG. 9*a* after attachment of the top deck to the mid-top member.
Figure 10:
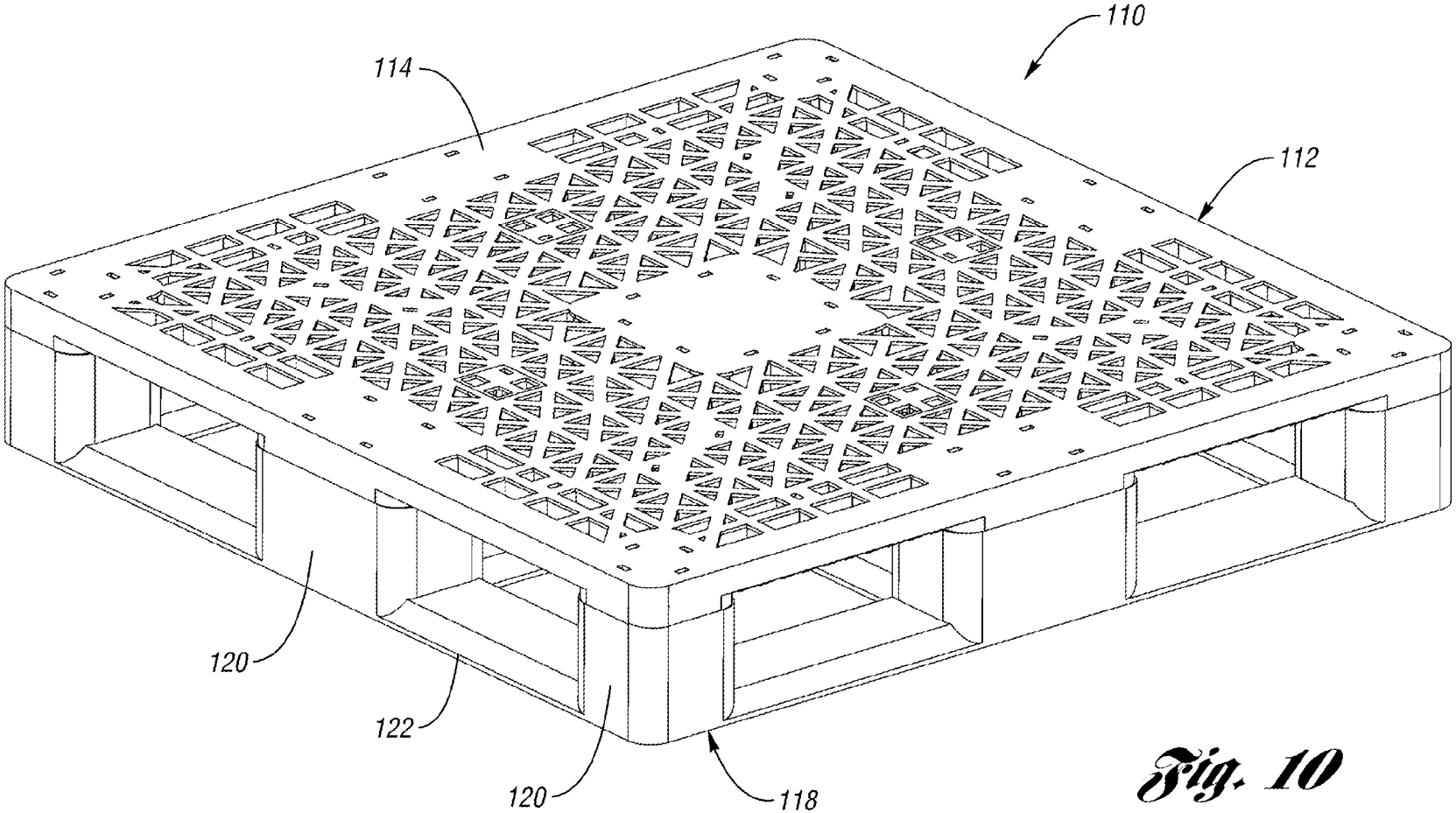
FIG. 10 is a perspective view of a pallet according to a second embodiment of the present invention.

In the embodiment shown, the mid-top member 30 is secured to the top deck 12 prior to connection of the top deck 12 to the base 18 in the manner shown in FIGS. 9*a*-9*b*. FIG. 9*a* is an enlarged view of the Area A of FIG. 7*b*, prior to connection of one of the ribs 46 to the mid-top member 30. In this embodiment, the mid-top member 30 is vibration welded to the ribs 46 of the top deck 12. During the vibration welding process, the projections 48 of the ribs 46 initially are brought into contact with the mid-top member 30. Most of each projection 48 and a portion of the mid-top member 30 in contact with each projection 48 are melted during the vibration welding process to connect the mid-top member 30 to the top deck 12 with a weld 73 as shown in FIG. 9*b*, at which time there will still be a small gap between the ribs 46 the mid-top member 30 at areas other than the projection 48, as shown. The top deck 12 and attached mid-top member 30 are then attached to base 18 in the snap-fit manner described above.

Variations on the pallet 10 could be made within the scope of the present invention. For example, some or all of the snap-tabs 54 could be switched to the base 18. The ribs 46 could be molded with the mid-top member 30 instead of, or in addition to, being molded with the top deck 12.

A pallet 110 according to a second embodiment of the present invention is shown in FIGS. 10-16. Components of the pallet 110 that are similar to the pallet 10 of FIG. 1-9 are pre-appended with the numeral "1" and unless shown or described differently, the description of those components from above is hereby incorporated by reference. The pallet 110 includes a top deck 112 having a generally planar upper member 114 for supporting goods at a distance above the floor. The top deck 112 is secured to a base 118 having a plurality of columns 120 connected by runners 122.

Figure 11:
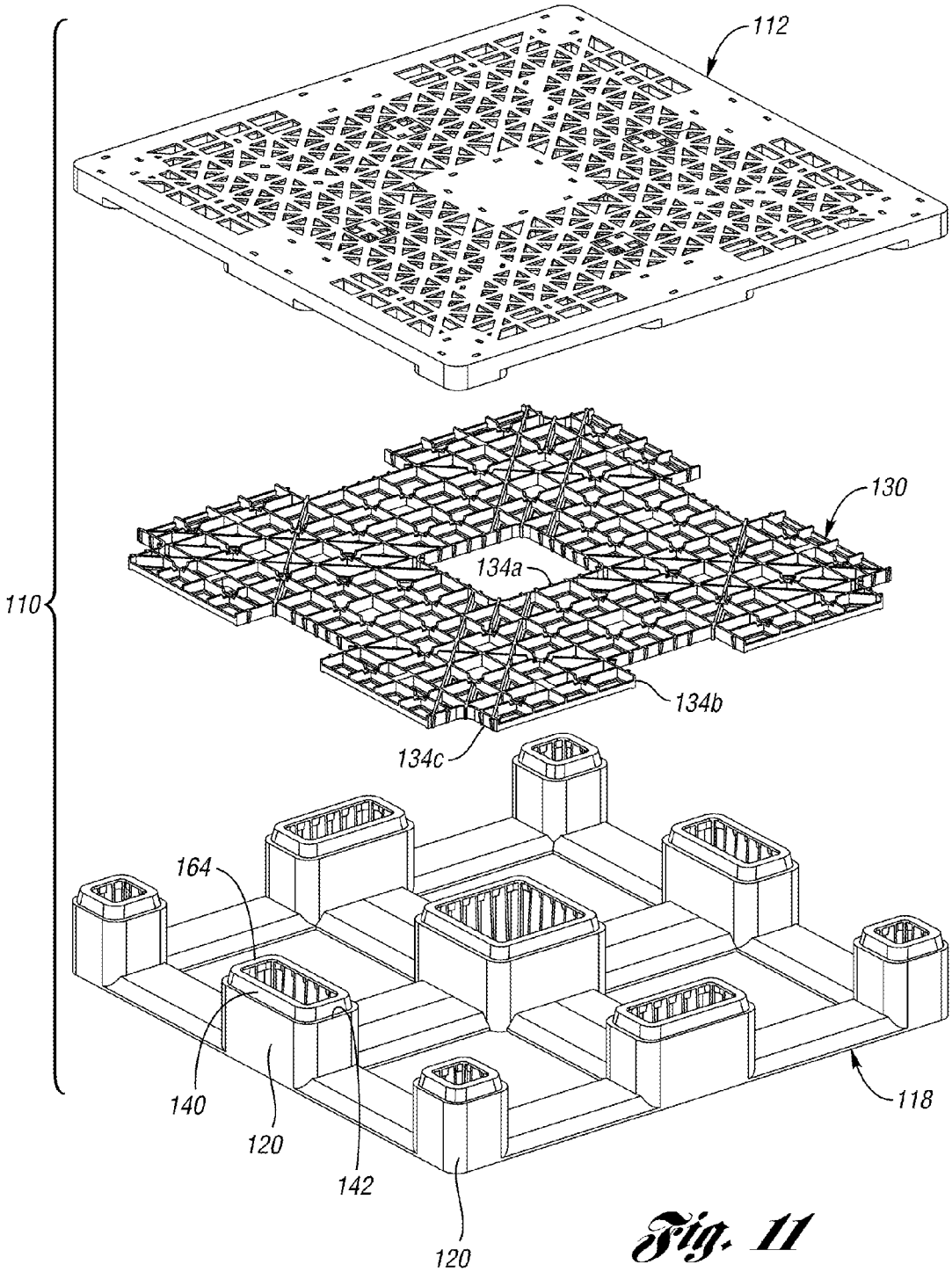
FIG. 11 is an exploded view of the pallet of FIG. 10.

FIG. 11 is an exploded view of the pallet 110. A mid-top member 130 is sandwiched between the top deck 112 and the base 118. The mid-top member 130 has a plurality of openings 134, including a center opening 134*a*, side openings 134*b* and corner openings 134*c*. The openings 134 correspond to and are aligned with the columns 120 of the base 118. The columns 120 each include an upper portion 140 having a reduced outer dimension, thereby forming a shoulder 142 adjacent the upper portion 140.

Figure 12:
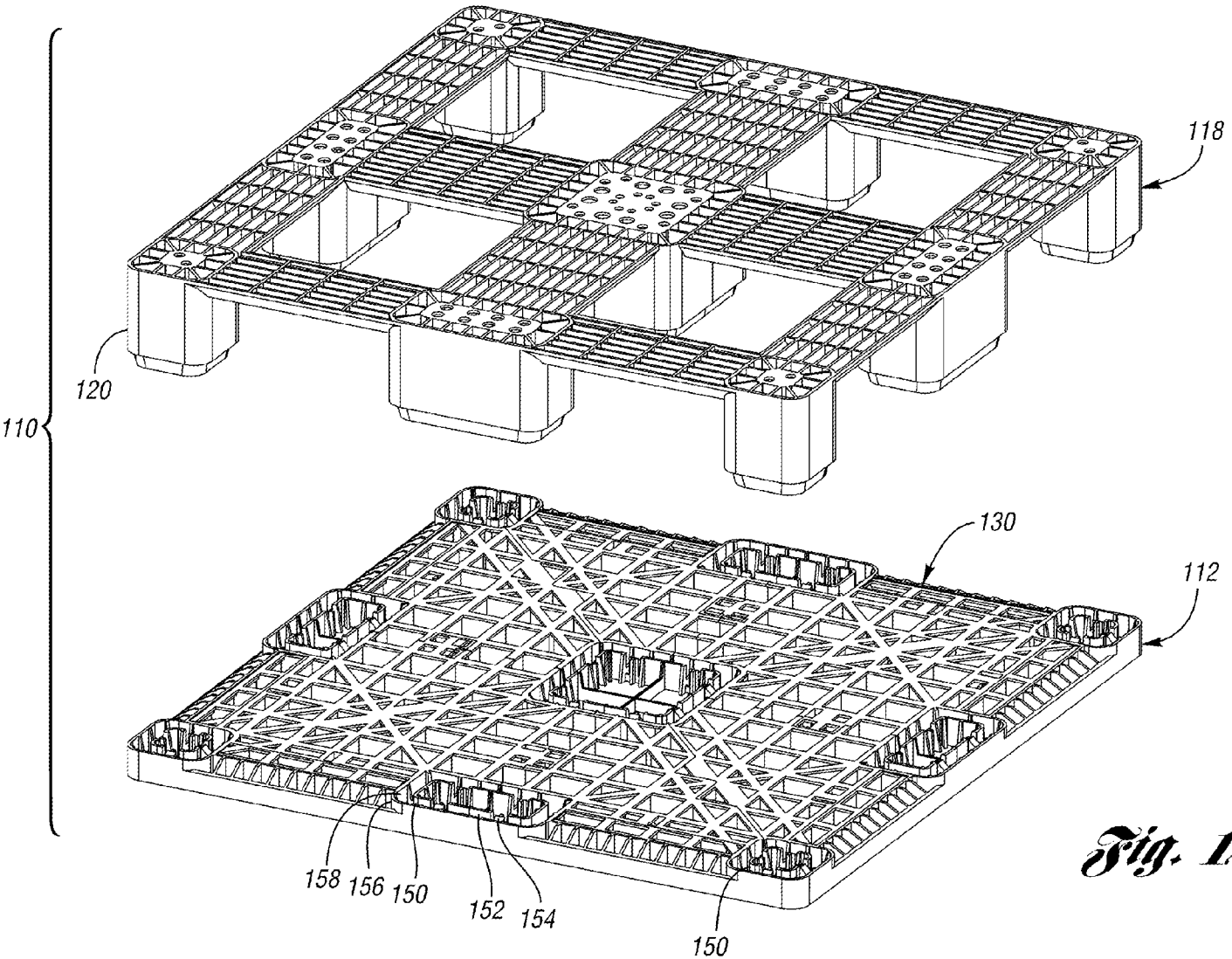
FIG. 12 is a bottom perspective view of the top deck connected to the mid-top member and exploded from the base of FIG. 10.

FIG. 12 is a bottom perspective partially exploded view of the top deck 112 and base 118, with the mid-top member 130 mounted to the top deck 112. The top deck 112 includes a plurality of column-receiving recesses 150. A plurality of interior ribs 152 and snap-tabs 154 extend downward within each recess 150. Short channel ribs 156 between the ribs 146 and the interior ribs 152 of each recess 150 define a channel 158.

Figure 13:
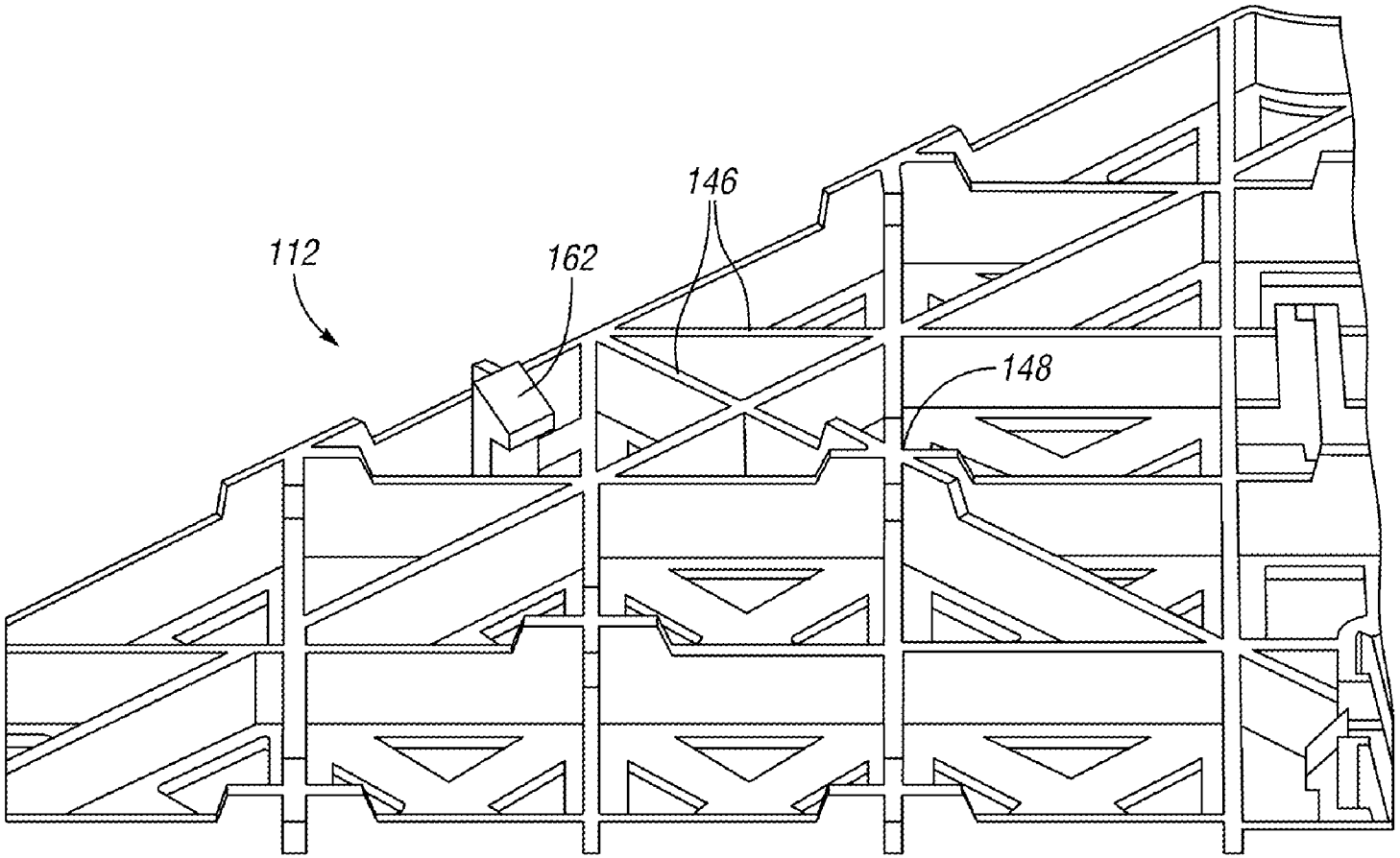
FIG. 13 is an enlarged perspective bottom view of a portion of the top deck of FIG. 10.

FIG. 13 is an enlarged perspective bottom view of a portion of the top deck 112. The underside of the top deck 112 includes a plurality of intersecting, transverse ribs 146 extending downward. At each intersection of the ribs 146, the ribs 146 are slightly taller to form downward projections 148. A plurality (one shown) of snap-tabs 162 extend downward from the top deck 112 slightly further than the ribs 146, for connecting the top deck 112 to the mid-top member 130. The snap-tabs 162 on the top deck 112 are aligned with, and connect to, lips 174 on the mid-top member 130, one of which is shown in FIG. 14.

Figure 14:
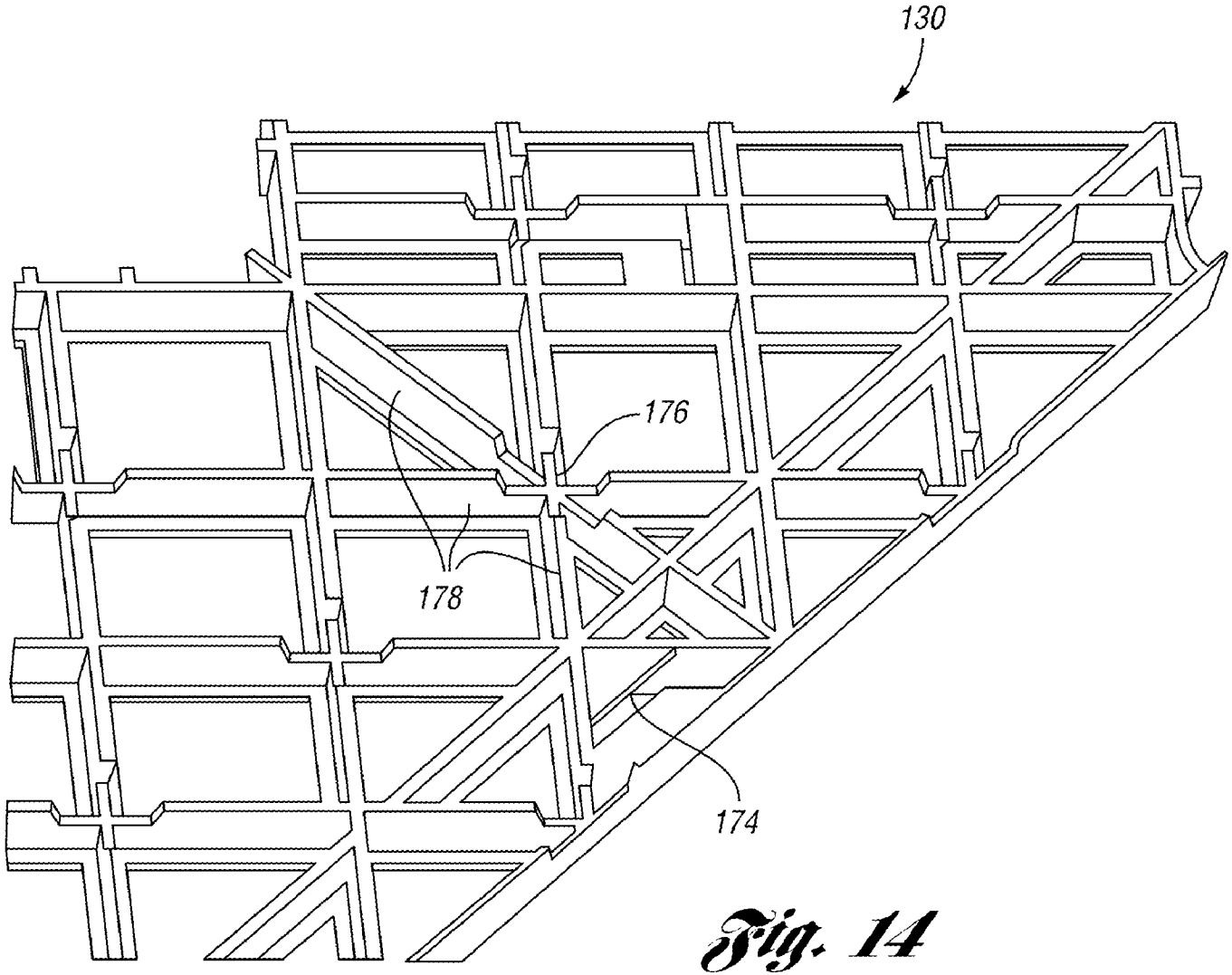
FIG. 14 is a bottom perspective view of the mid-top member of FIG. 10.

FIG. 14 is a bottom perspective view of the mid-top member 130. Recesses 176 at the intersections of the ribs 178 align with, and receive, the projections 148 on the top deck 112, as shown in FIG. 15.

Figure 15:
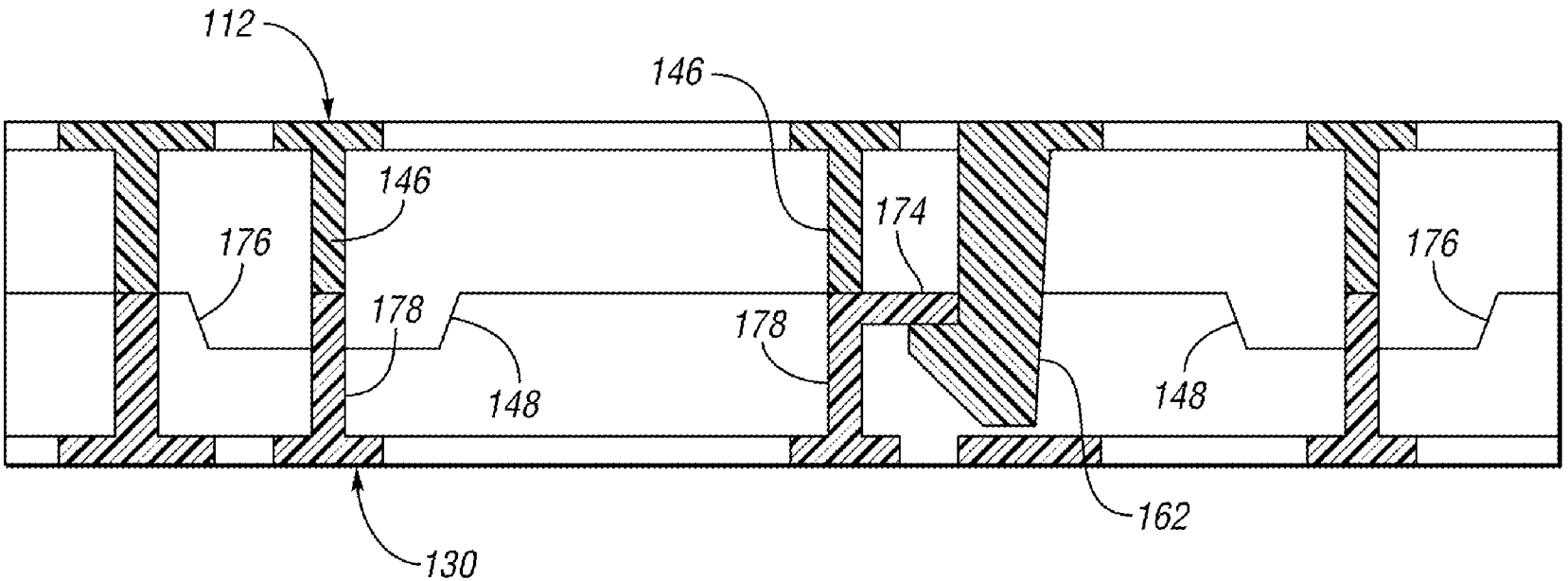
FIG. 15 is a sectional view through the mid-top member and top deck of FIG. 10.

FIG. 15 is a sectional view through the mid-top member 130 connected to the top deck 112. The projections 148 of the top deck 112 are received within corresponding recesses 176 in the mid-top member 130 in order to laterally align the top deck 112 and mid-top member 130. The ribs 178 of the mid-top member 130 are aligned with and connected to the ribs 146 of the top deck 112. The snap-tabs 162 of the top deck 112 snap into engagement with the lips 174 of the mid-top member 130 to retain the top deck 112 to the mid-top member 130.

Figure 16:
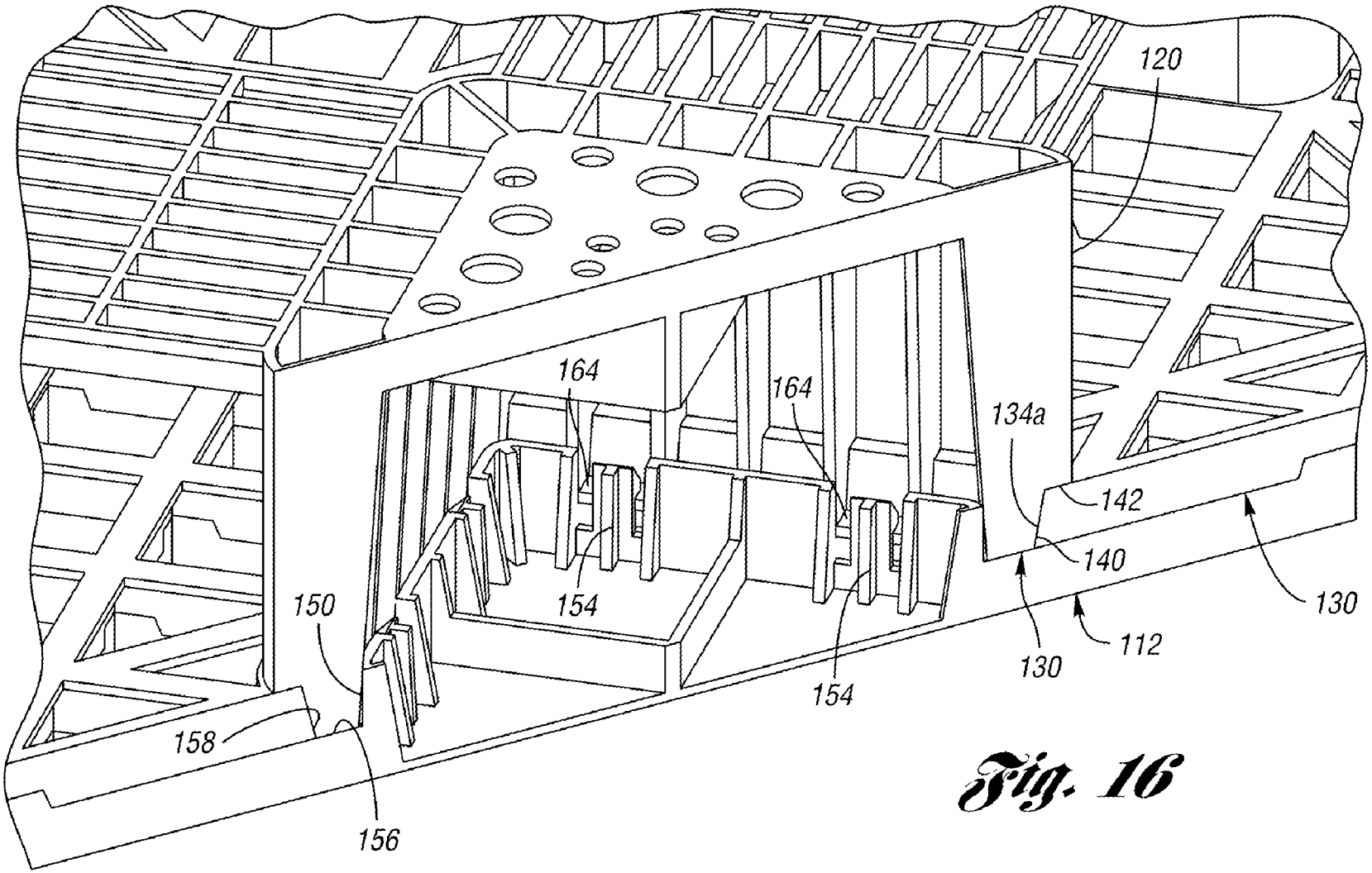
FIG. 16 is bottom perspective view of a diagonal section through the assembled pallet of FIG. 10.

The top deck 112 and mid-top member 130 are then snap-fit assembled to the base 118 as shown in FIG. 16. FIG. 16 is bottom perspective view of a diagonal section through the assembled pallet 110 of FIG. 10. As shown, the upper portion 140 of each column 120 is received in the channel 158 of one of the recesses 150 to abut the short channel ribs 156 and is also received within one of the openings 134 of the mid-top member 130. The mid-top member 130 is disposed on the shoulder portions 142 of the columns 120. Lips 164 on the columns 120 are snap-fittingly connected to the snap-tabs 154 on the top deck 112.

Variations on the pallet 110 could be made within the scope of the present invention. For example, some or all of the snap-tabs 154 could be switched to the base 118. Likewise, the locations of some or all of the snap-tabs 162 could be switched to the mid-top member 130.

In both embodiments, the top deck 12, 112, mid-top member 30, 130 and base 18, 118 are each separately molded preferably from polypropylene or other suitable material, such as HDPE, glass-filled nylon or other suitable materials via an injection-molding or other suitable process.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pallet for use with a fork lift comprising:

a deck;

a column including an upper portion having a reduced outer dimension, a snap-tab securing the column to the deck, wherein the column includes a shoulder on an outer surface of the column;

a generally planar mid-top member having an opening through which is received the upper portion of the column, the mid-top member between the column and the deck, wherein the mid-top member is disposed between the shoulder of the column and the deck; and a plurality of ribs connecting the mid-top member and the deck.

2. The pallet of claim 1 wherein the upper portion at least partially protrudes through the mid-top member and into the deck.

3. A pallet for use with a fork lift comprising:

a deck;

a column including an upper portion having a reduced outer dimension, a snap-tab securing the column to the deck, wherein the snap-tab is integrally molded with the deck and extends downwardly from the deck, the snap-tab including a shoulder adjacent a sloped portion of the snap-tab, wherein the column includes a flange extending radially inwardly into an interior of the column, the shoulder of the snap-tab secured below the flange to secure the column to the deck;

a generally planar mid-top member having an opening through which is received the upper portion of the column, the mid-top member between the column and the deck, wherein the column includes a shoulder on an outer surface of the column, and the mid-top member is disposed on the shoulder of the column; and a plurality of ribs connecting the mid-top member and the deck, wherein the plurality of ribs are integrally formed with the deck, the shoulder is recessed within the plurality of ribs, and the upper portion at least partially protrudes through the mid-top member and is at least partially disposed between the plurality of ribs.

4. A pallet for use with a fork lift comprising:

a deck;

a plurality of columns including a center column substantially perpendicular to the deck and defining fork-receiving regions therebetween, a snap-tab securing the columns to the deck, wherein the columns each include a shoulder on an outer surface of the column;

a mid-top member secured to the deck, the mid-top member at least substantially circumscribing the center column, wherein the mid-top member is disposed between the deck and the shoulders of the columns; and a plurality of ribs between the plurality of columns, the plurality of ribs extending between the deck and the mid-top member.

5. The pallet of claim 4 wherein the columns each include an upper portion having a reduced outer dimension, the upper portions at least partially protruding through the mid-top member to the deck.

6. A pallet for use with a fork lift comprising:

a deck;

a plurality of columns including a center column and at least four peripheral columns substantially perpendicular to the deck and defining fork-receiving regions therebetween, a plurality of snap-tabs securing each of the plurality of columns to the deck, each of the plurality of columns including an upper portion of reduced diameter, thereby forming a shoulder adjacent the upper portion; and a mid-top member secured to the deck by a plurality of ribs, the mid-top member abutting the shoulder of each of the plurality of columns, the mid top member between the deck and the shoulders of the plurality of columns.

7. The pallet of claim 6 wherein the peripheral columns are corner columns.

8. The pallet of claim 6 wherein the peripheral columns are side columns.

9. The pallet of claim 6 wherein the deck has the plurality of ribs extending downwardly therefrom, and wherein the mid-top member abuts the plurality of ribs on the deck.

10. The pallet of claim 9 wherein the mid-top member is secured to each of the plurality of ribs on the deck.

11. The pallet of claim 6 wherein the plurality of columns are hollow.

12. The pallet of claim 6 wherein the plurality of ribs extend downwardly from the deck.

* * * * *